US006178911B1

(12) United States Patent
Hemphill et al.

(10) Patent No.: US 6,178,911 B1
(45) **Date of Patent: *Jan. 30, 2001**

(54) AUTOMATICALLY INFLATABLE BOAT

(75) Inventors: Douglas Hemphill; Gary Dale, both of Delta (CA)

(73) Assignee: Zodiac Hurricane Technologies, Inc., British Columbia (CA)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/106,307

(22) Filed: Jun. 29, 1998

(51) Int. Cl.[7] ..... B63B 7/00
(52) U.S. Cl. ..... 114/345; 441/41
(58) Field of Search ..... 441/35, 39–42; 114/345, 68

(56) References Cited

U.S. PATENT DOCUMENTS

| | | | | |
|---|---|---|---|---|
| D. 151,947 | | 10/1948 | Potts et al. . | |
| 1,667,912 | * | 5/1928 | Vlahon | 441/40 |
| 1,686,366 | | 10/1928 | Boyle . | |
| 2,040,616 | | 5/1936 | Mapes . | |
| 2,391,906 | | 1/1946 | Kearny . | |
| 2,403,436 | * | 7/1946 | Heigis | 114/345 |
| 2,908,919 | * | 10/1959 | Bicknell et al. | 441/38 |
| 3,629,875 | * | 12/1971 | Dow et al. | 4/599 |
| 4,919,067 | * | 4/1990 | Wenstob et al. | 114/345 |
| 5,113,779 | * | 5/1992 | Amrein et al. | 114/270 |
| 5,267,363 | | 12/1993 | Chaffee . | |
| 5,282,437 | | 2/1994 | Avillez de Basto . | |
| 5,342,230 | * | 8/1994 | Louis | 441/42 |

FOREIGN PATENT DOCUMENTS

| | | |
|---|---|---|
| 881164 | 6/1953 | (DE) . |
| 2377320 | 8/1978 | (FR) . |
| 2208158 | 3/1989 | (GB) . |
| WO 98/00333 | 1/1998 | (WO) . |

* cited by examiner

*Primary Examiner*—Ed Swinehart
(74) *Attorney, Agent, or Firm*—Dean W. Russell; Kilpatrick Stockton LLP

(57) ABSTRACT

An automatically inflatable boat including at least two separate compartments which are connected to one another by an intercommunicating valve which can be opened to connect adjacent compartments or closed to isolate adjacent compartments. The inflatable boat is provided with a gas pump permanently mounted on the boat and in fluid communication with a connection for receiving pressurized gas of at least one of the inflatable compartments. The pump can be actuated in order to automatically inflate the inflatable compartments of the boat to a preset pressure. Also shown is an inflatable enclosure which can be deflated and inflated and to house an adult and a commode to provide privacy.

20 Claims, 2 Drawing Sheets

AUTOMATICALLY INFLATABLE BOAT

BACKGROUND OF THE INVENTION

1. Field of the Invention

The present invention relates to inflatable boats and more particularly to an automatic inflation system for inflatable boats.

2. Description of the Prior Art

Numerous examples of inflatable boats are known in the art. Such inflatable boats must, by law, be formed from at least two separate inflatable chambers which typically form the side of the boat.

An example of a collapsible inflatable boat is shown in Design Pat. No. 151,467. In this patent, the boat is formed from three separate inflatable chambers each of which has its own valve member for inflating and deflating the chambers. In such a boat, it is necessary to inflate and/or deflate each chamber separately. This is a tedious process which requires a great deal of time and effort since the chamber must be inflated, the pressure checked, further inflation and/or deflation carried out and the process must be repeated in order to arrive at the appropriate pressure.

U.S. Pat. No. 2,040,616 (Mapes) discloses an inflatable flotation device which is formed from a plurality of inflatable chambers. Each inflatable chamber has its own outlet passage for inflation and deflation. The inflatable boat is provided with a pressure medium storage container which is connected to a distributing manifold which distributes the pressure medium from the container to the outlet passages of the respective inflatable chambers. This system provides a one-time filling of the two chambers of the boat using the entire container of pressure medium.

The system of U.S. Pat. No. 2,040,616 suffers from the disadvantages that it can only be used if the inflatable compartments are entirely empty since the only way of controlling the amount of pressure in the inflatable compartments is by choosing a pressure medium container of the proper size. No pressure gauge or other means for partially inflating the chambers is provided. In addition, the entire container of pressure medium is used to fill the inflatable chambers and thus this device can only be used for a one time filling then the pressure medium container has to be replaced. Finally, there is no provision for topping off the inflatable chambers should they become partially deflated as a result of any number of factors such as temperature changes, striking an object or pounding on the water.

It is also known in the art from, for example, the Zodiac TMF 470, to provide an inflatable boat having a plurality of inflatable compartments which are connected with one another by virtue of intercommunicating valves which can be opened to connect all of the compartments or closed to isolate each compartment from the others. Such inflatable boats are typically inflated by opening all of the intercommunicating valves and inflating all of the compartments simultaneously via one valve. This ensures a constant pressure throughout the inflatable compartments. However, the disadvantage of this method is that inflation must be carried out without knowledge of the pressure and/or inflation must be stopped in order to check the pressure during inflation. This is a tedious, cumbersome process which can result in over or under inflation of the boat if not done properly. Further, because this is a tedious process there is a possibility that it may be postponed or neglected by the owner of the boat thereby reducing the service life of the boat.

Accordingly, there is need in the art for an automatically inflatable boat which can be used to easily inflate the boat without undue effort on the part of the owner.

There is a further need in the art for an inflatable boat with an automatic inflation system which can be used to easily top-off the pressure in the inflatable boat prior to each used.

There is a further need in the art for an inflatable boat with an automatic inflation system which can also be used to deflate the boat to thereby make it much simpler to deflate the boat for storage and reinflate the boat for use.

It is the primary object of the present invention to provide an inflatable boat with an automatic inflation system.

These and other objects of the present invention will be apparent from the summary and detailed description which follow.

SUMMARY OF THE INVENTION

In a first aspect, the present invention relates to an automatically inflatable boat formed by a deck and at least two separate inflatable compartments attached to the deck. Each of the inflatable compartments is connected to at least one adjacent inflatable compartment by an intercommunicating valve which can be opened to connect adjacent compartments or closed to isolate adjacent compartments. At least one of the inflatable compartments includes a valve provided with a connection for receiving pressurized gas from an external source. A gas pump is permanently mounted on the boat and in fluid communication with the connection for receiving pressurized gas. The boat also includes a means for actuating the pump.

In a second aspect, the present invention relates to a boat including a deck and a sidewall and an inflatable enclosure of sufficient size to admit an adult located on the deck. A pump is located on the boat for inflating the inflatable enclosure and a means is provided for actuating the pump to cause the pump to inflate the enclosure.

The present invention provides an apparatus for automatic inflation of a boat which is convenient, easy to use, can be reused and which is simple to use to top-off the inflatable compartments. In addition, the present invention provides a boat with an inflatable enclosure which can be employed for temporary shelter or privacy.

DETAILED DESCRIPTION OF THE PREFERRED EMBODIMENTS

In the following description, like numerals represent like elements throughout the several views.

Figure 1:
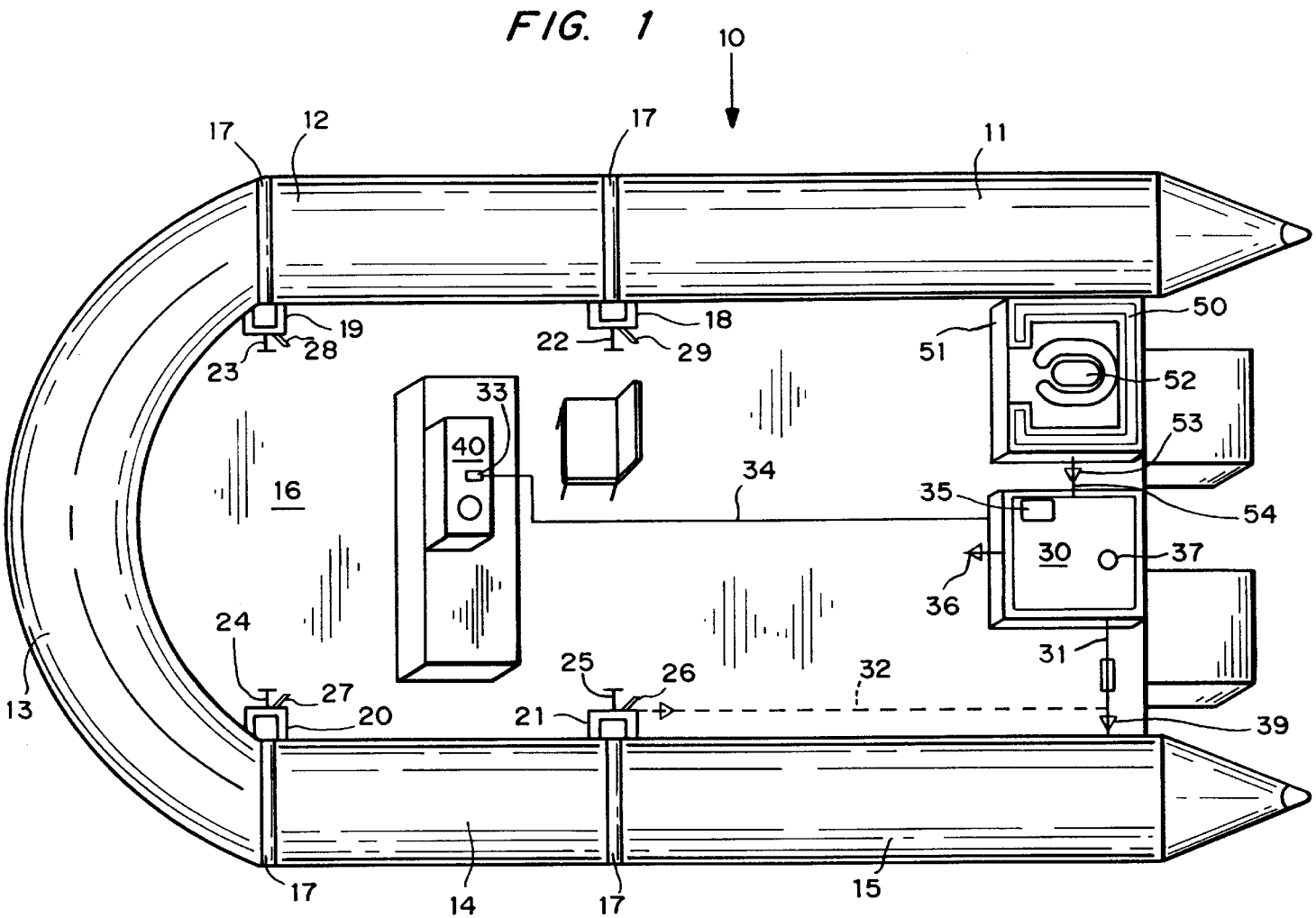
FIG. 1 is a top perspective view of an inflatable boat in accordance with the present invention.

Referring to FIG. 1, there is shown an inflatable boat 10 which includes five inflatable tube elements 11, 12, 13, 14, 15 attached around the periphery of deck 16. The inflatable tube elements 11–15 each have end caps 17 which may be formed from a fabric material and which serve to define the form of the inflatable tube elements 11–15 as well as provide structural stability thereto.

Each of the inflatable tube elements 11–15 is connected to the adjacent inflatable tube element by intercommunicating valves 18, 19, 20, 21. Intercommunicating valves 18–21 are conventional valves known to those of ordinary skill in the art and thus will not be described in great detail here. Intercommunicating valves 18–21 can be opened to connect adjacent inflatable tube elements 11–15 or can be closed to isolate the inflatable tube elements. Such opening and closing is generally done manually by valve actuating means 22, 23, 24, 25. The valve actuating means 22–25 may be any conventional means for actuating valves including knobs, electric switches, or any other mechanical actuators known to those of skill in the art.

Each of the intercommunicating valves 18–21 may optionally include a safety valve 26, 27, 28 and 29 for releasing excess pressure in the inflatable compartments 11–15. Excess pressure can result from increases in ambient temperature after inflation, pounding against the water or striking an object when the boat is operating at high speed.

The automatically inflatable boat includes an inflation pump 30 which is connected to at least one of the inflatable compartments 11–15 either by a direct connection 31 or via an intercommunicating valve as shown in FIG. 1 by connection 32 (shown as a dotted line) to intercommunicating valve 21. If the pump 30 is connected via a direct connection 31 to the inflatable compartments 11–15, the connection 31 is provided with a valve 39 for closing the connection 31 between pump 30 and the inflatable compartments 11–15. Pump 30 is preferably actuated by a pump actuator 33 which may be a manual or electronic actuating system. In the case of a manual actuating system, the actuator (not shown) is preferably located on the pump 30. In the case of an electronic actuator the actuator may be located on the pump 30 (not shown) or, more preferably, pump actuator 33 is located on the dashboard 40 whereby it is connected by an electrical connection 34 to pump 30. Also, an optional pressure indicator 37 may be located on the pump or dashboard, and shows the current pressure in the inflatable tube elements. Pressure indicator 37 may be adjustable so that the operator of the automatic inflation system can set the desired pressure for the inflatable tube elements 11–15.

Pump 30 may be any conventional pump. Preferably, pump 30 is operable with a 12 volt battery. Optionally, pump 30 may be a reversible pump. If so, pump 30 preferably includes a switch 35 for reversing pump 30 so that it can be used to both inflate and deflate the inflatable compartments 11–15. Switch 35 is shown schematically in FIG. 1 since it may be any conventional switch for reversing a pump.

Pump 30 may also optionally include an automatic shut-off 36 which can be set at a predetermined pressure to automatically shut-off the pump if the pressure in one or more of the inflatable compartments exceeds a predetermined level. Any conventional automatic shut-off for a pump may be employed.

Figure 2:
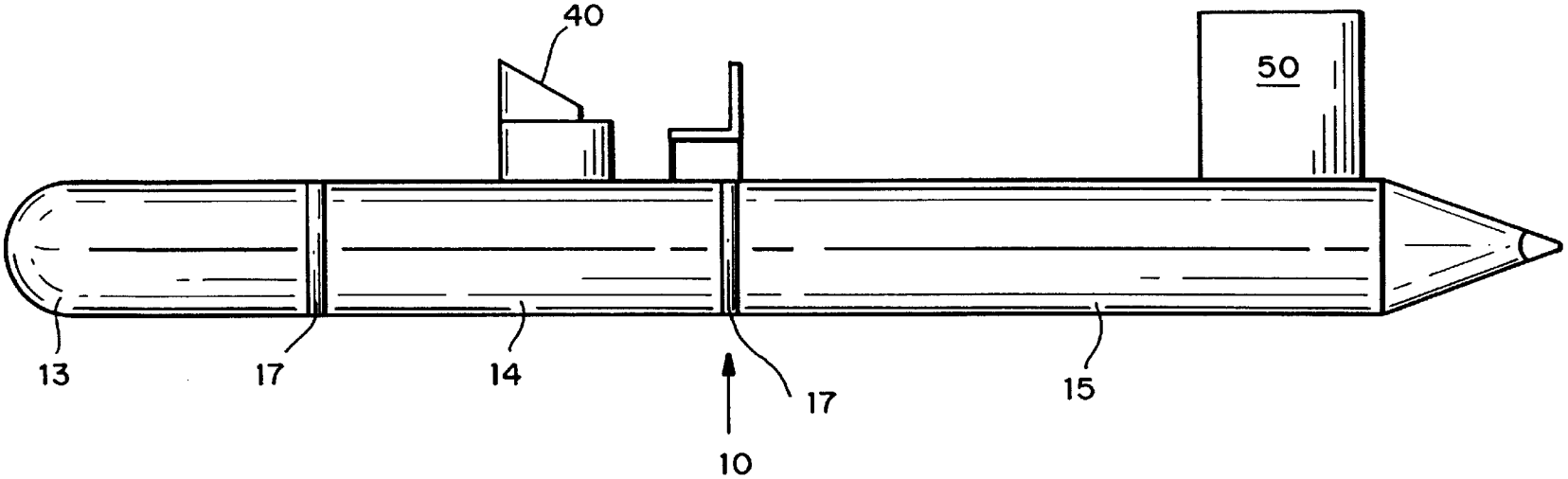
FIG. 2 is a side view of the inflatable boat in accordance with the present invention showing the inflatable enclosure in the inflated condition.

In a second embodiment of the present invention, the inflatable boat includes an inflatable enclosure 50 shown in its deflated form in FIG. 1 and in its inflated form in FIG. 2. Inflatable enclosure 50 is preferably at least of sufficient size to admit an adult in a sitting position when in its inflated condition. Inflatable enclosure 50 may be made of any suitable inflatable material which collapses upon deflation.

In its deflated form, inflatable enclosure 50 fits into a housing 51 as shown in FIG. 1. Preferably, inflatable enclosure 50 houses a commode 52. Inflatable enclosure 50 includes a fill valve 53 which is connected to pump 30 by a connection 54.

The foregoing description has been presented for the purposes of illustration and description only and is not to be construed as limiting the invention in any way. The scope of the invention is to be determined from the claims appended hereto.

What is claimed is:

1. An inflatable boat which comprises:

a) a boat formed by a deck and at least two separate inflatable compartments attached to the deck, b) an interconnecting valve assembly (i) connecting each of said inflatable compartments to at least one adjacent inflatable compartment and (ii) which can be opened to connect adjacent compartments or closed to isolate adjacent compartments, c) at least one of said inflatable compartments including a valve provided with a connection for receiving pressurized gas from an external source, d) a gas pump permanently mounted on the boat and in fluid communication with the connection for receiving pressurized gas, the pump being reversible to deflate the inflatable compartments for storage of the boat, and e) an actuator for the pump.

2. An inflatable boat as claimed in claim 1 wherein the intercommunicating valve assembly includes a safety valve which releases excess pressure when the pressure in one or more of said inflatable compartments exceeds a predetermined level.

3. An inflatable boat as claimed in claim 1 wherein the pump includes an automatic shut off to shut off the pump if the pressure in the inflatable compartment exceeds a predetermined level.

4. An inflatable boat as claimed in claim 3 wherein the automatic shut off for the pump includes a pressure indicator which can be set by an operator to a predetermined pressure for the inflatable compartments.

5. An inflatable boat as claimed in claim 4 wherein the boat has a dashboard, the pressure indicator is located on the dashboard of the boat and is connected to the pump.

6. An inflatable boat as claimed in claim 5 wherein the actuator for the pump is located on the dashboard of the boat.

7. An inflatable boat as claimed in claim 1 further comprising an inflatable enclosure of sufficient size to admit an adult, including a fill valve and wherein the pump is connected to the fill valve of the enclosure so that the enclosure can be automatically inflated and deflated.

8. An inflatable boat as claimed in claim 7 further comprising a housing large enough to house the inflatable enclosure when in a deflated condition.

9. An boat as claimed in claim 8 wherein the inflatable enclosure, when inflated, encloses a commode.

10. An automatically inflatable boat as claimed in claim 1 wherein the pump is permanently mounted on the deck of the boat.

11. A boat comprising a deck, an inflatable enclosure of sufficient size to admit an adult located on the deck, a pump located on the boat (i) capable of inflating the inflatable enclosure and (ii) reversible so as to be capable of deflating the inflatable enclosure, and an actuator for the pump to cause the pump to inflate the inflatable enclosure.

12. A boat as claimed in claim 11 wherein the inflatable enclosure encloses a commode.

13. A boat as claimed in claim 12 wherein the boat further comprises a housing which houses the inflatable enclosure when in a deflated condition.

14. A boat as claimed in claim 13 wherein the pump includes a manually operated valve for reversing the pump.

15. An inflatable boat having an automatic pressure regulating system and a deck defining a periphery, comprising:

a. a pump mounted on the boat;

b. a plurality of inflatable compartments defined by at least one inflatable element attached to the periphery of the deck;

c. means, comprising a valve, for connecting the pump so as to communicate with at least one of the inflatable compartments;

d. an actuator for the pump; and e. a pressure indicator connected to the actuator and adjustable to a desired pressure setting so as automatically to regulate the inflation pressure of the at least one compartment with which the pump communicates in accordance with the pressure setting of the indicator.

16. An inflatable boat according to claim 15 in which the pump communicates at least indirectly with the plurality of inflatable compartments so as to top-off their inflation pressure concurrently.

17. An inflatable boat according to claim 16 in which the pump is reversible.

18. An inflatable boat comprising:

a. a deck having a periphery;

b. at least one inflatable element attached to the periphery of the deck; and c. an inflatable assembly mounted to the deck and comprising:

i. a commode;

ii. an inflatable enclosure housing the commode; and iii. a valve communicating with the enclosure to allow inflation thereof.

19. An inflatable boat according to claim 18 further comprising a pump mounted thereon and adapted for connection to at least one of the inflatable element or valve of the inflatable assembly.

20. An inflatable boat according to claim 19 in which the pump is reversible and adapted for connection to the valve of the inflatable assembly to permit deflation of the inflatable enclosure.

* * * * *